United States Patent [19]

Reno et al.

[11] 4,121,494

[45] Oct. 24, 1978

[54] PROTECTIVE COVER FOR THE STRINGS OF A MUSICAL INSTRUMENT

[76] Inventors: David L. Reno, 3724 NE. 18 Ter., Pompano Beach, Fla. 33064; Keith W. Donovan, 2570 NE. 22nd St., Pompano Beach, Fla. 33062

[21] Appl. No.: 863,488

[22] Filed: Dec. 22, 1977

[51] Int. Cl.[2] ..... G10G 7/00

[52] U.S. Cl. ..... 84/453

[58] Field of Search ..... 84/183, 267, 310, 311, 84/453

[56] References Cited

U.S. PATENT DOCUMENTS

| | | | |
|---|---|---|---|
| 536,634 | 4/1895 | Kyle | 84/263 |
| 1,772,725 | 8/1930 | Lewis | 84/310 |
| 2,483,268 | 9/1949 | Fawick | 84/310 |
| 3,525,284 | 8/1970 | Almeida | 84/453 |
| 3,971,287 | 7/1976 | Ito | 84/453 |

*Primary Examiner*—Lawrence R. Franklin
*Attorney, Agent, or Firm*—Meredith P. Sparks

[57] ABSTRACT

An elongated clip configurated shield to encase the strings of a musical instrument, the shield being formed of a yieldable plastic material with a cloth lining, impregnated with a rust and moisture inhibitor chemical, securely cemented therewithin.

8 Claims, 3 Drawing Figures

PROTECTIVE COVER FOR THE STRINGS OF A MUSICAL INSTRUMENT

BACKGROUND OF THE PRESENT INVENTION

The strings of musical instruments such as guitars, banjos, violins, etc. are generally affected by adverse atmospheric conditions, particularly a humid condition, causing a deterioration in tonal quality.

In the case of metal strings as on a guitar, banjo, etc. corrosion and rust forms, resulting in frequent string failures.

SUMMARY OF THE INVENTION

The plastic shield device of the present invention lengthens the life span of the strings of a musical instrument while preserving the tone quality of the instrument to which it is applied. The clip shaped shield is lined with soft cloth material such as terry cloth or velvet, for example, which is impregnated with a rust and moisture inhibitor chemical.

Therefore, one of the principal objects of the present invention is to provide a protective covering unit for the strings of musical string instruments such as guitars, banjos, violins, etc., which will help to maintain the tone quality produced by the strings, and prolong the life thereof during the time of actual engagement on an instrument.

A further object of the invention is to provide a protective covering unit which is inexpensive and which may be easily and quickly engaged and disengaged relative to a covering relation with the strings of a musical instrument.

Another object of the invention is to provide a protective covering unit for the strings of a musical instrument which includes an inner cloth lining for engagement with the strings and which is impregnated with a rust and moisture inhibitor chemical.

DETAILED DESCRIPTION OF A PREFERRED EMBODIMENT

Figure 1:
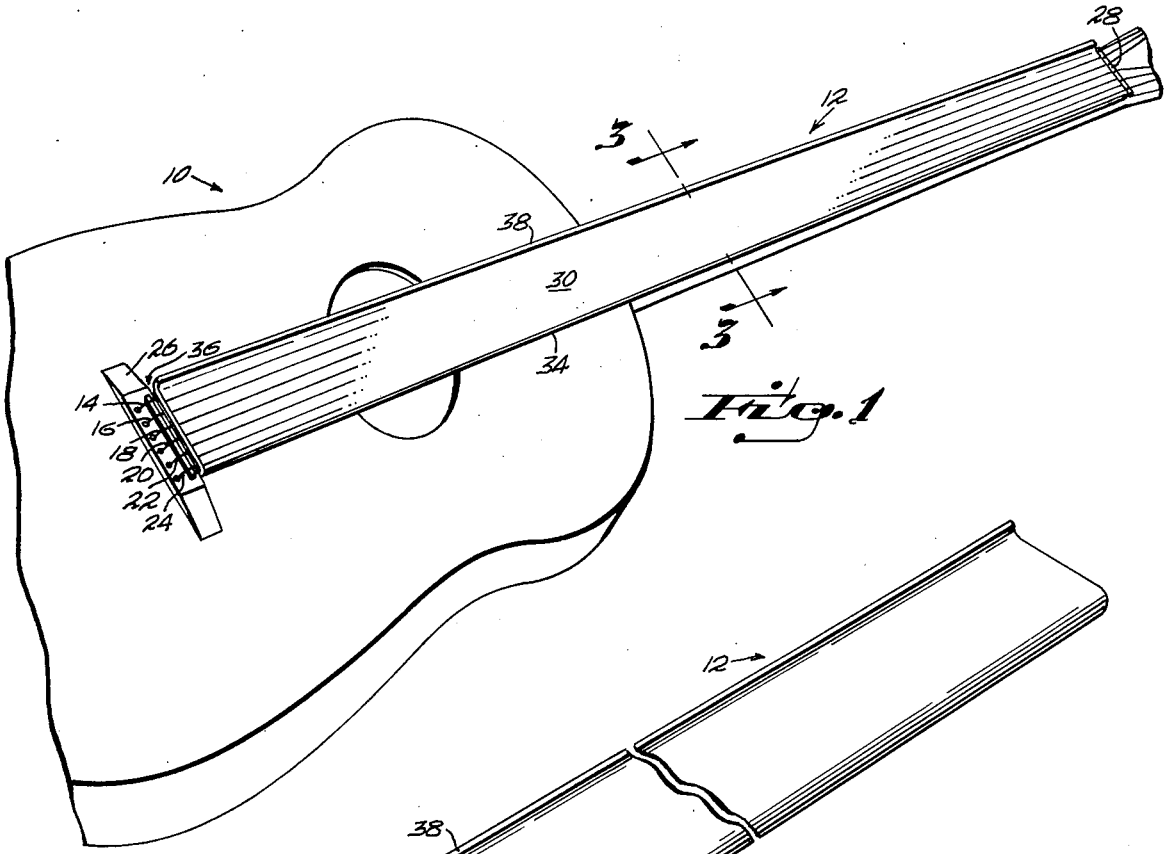
FIG. 1 is a fragmentary perspective view of a guitar with a protective cover of the present invention engaged in a covering relation to the strings thereof.

With reference to the drawings in which like reference characters designate like or corresponding parts throughout the several views, and with particular reference to FIG. 1, a guitar 10 is illustrated with a protective shield 12 of the present invention in a covering relation to the guitar strings 14 through 24. Strings 14 through 24 include functional lengths which span the distance between a bridge 26 and a nut 28 of the guitar in the conventional manner and the protective shield 12 is preferably of a length so as to cover the strings substantially along the length of said span. The shield can, of course, be shorter or longer than the entire length, when desirable for other reasons.

Figure 2:
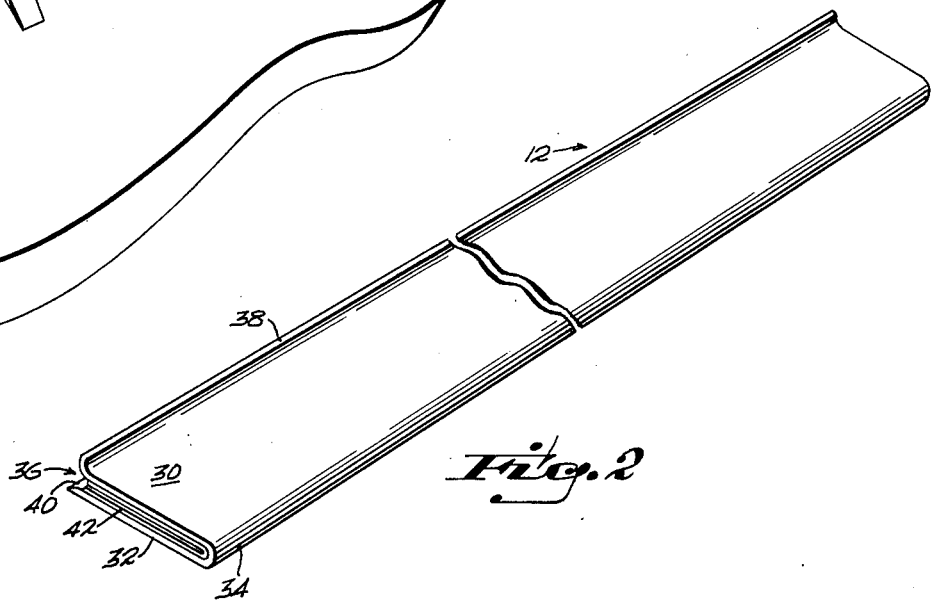
FIG. 2 is an enlarged fragmentary perspective view of the protective cover.
Figure 3:
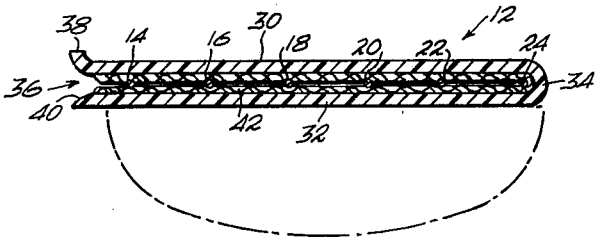
FIG. 3 is a further enlarged cross-sectional view taken along line 3—3 of FIG. 1.

With reference to FIGS. 2 and 3, the shield 12 is generally clip shaped in cross section including top and bottom planar, spaced apart, generally parallel confronting walls 30 and 32 with an interconnecting closure web 34 along a first longitudinal side edge thereof.

The second longitudinal side edge defines an elongated open mouth 36 formed by an upwardly rounded lip 38 along the length of upper wall 30 and a downwardly rounded edge of portion 40 along the length of lower wall 32. Open mouth 36 facilitates the insertion of shield 12 over the strings as seen in FIG. 1.

The confronting inner surfaces of walls 30, 32 and web 34 are lined with a suitable soft cloth 42, such as terry cloth or velvet, for example, which is bonded thereto, as by a suitable adhesive. The cloth 42 is impregnated with a suitable chemical such as a silicone or other chemical, which inhibits the accumulation of moisture on the strings and the resulting corrosion and rust.

For example, the shield may be extruded of any suitable plastic material and cut to a desired length to fit between the bridge and nut 26, 28 and adhesively lined with the chemically treated cloth 42.

While the protective shield 12 of the present invention is illustrated and described relative to a guitar it is equally applicable in various sizes to most other string instruments such as a banjo, base guitar, pedal steel guitar or mandalin.

One preferred rust and moisture inhibitor chemical is dimethyl silicone. The dimethyl silicone is first mixed with water in the proportions of about 20–25% by volume of silicone and 80–75% by volume of water. The proportions are not critical. To preserve the water in the mixture a chemical such as methylparaben may be added to the water before mixing with the silicone, in an amount of 0.05% to 1.5% by volume. The amount is not critical.

The cloth is saturated with the aqueous dimethyl silicone, the excess liquid removed, for example, by wringing out the cloth, and the cloth air dried for use in lining the clip.

Other silicones may be used, for example, an organosilicon oxide polymer in which the structural unit is $—R_2Si—O—$ where R is a monovalent organic radical. Examples are methyl and phenyl. These silicones may be fluids, oils or resins and are well known for their water repellant qualities. They also act as release agents. Other chemicals having such qualities may also be employed for this purpose.

We claim:

1. A protective cover for the strings of a musical instrument of the type having a plurality of relatively closely spaced apart strings including functional string lengths longitudinally spanning the distance between a bridge and a nut comprising, a shield including top and bottom spaced apart, generally parallel confronting walls with an interconnecting closure web along a first longitudinal side edge thereof, said top and bottom walls defining an elongated open mouth along a second longitudinal side edge thereof, said shield having a length substantially equal to said distance between said bridge and said nut and a width sufficient to extend across said plurality of strings, and lining means in said space between said top and bottom walls.

2. The protective cover as defined in claim 1 wherein said lining means comprises a cloth lining adhesively secured within said space.

3. The protective cover as defined in claim 2 wherein said cloth lining is impregnated with a moisture and rust inhibitor chemical.

4. The protective cover as defined in claim 3 wherein said shield and cloth lining are sized protectively to encase the plurality of strings along the length of the span between the bridge and nut.

5. The protective cover as defined in claim 3 wherein said chemical is an aqueous mixture of dimethyl silicone to which has been added a preservative for the water.

6. The protective cover as defined in claim 3 wherein said chemical is a silicone.

7. The protective cover as defined in claim 1 wherein said open mouth includes an upwardly rounded lip portion along the length of said top wall and a downwardly rounded edge portion along the length of said bottom wall.

8. The protective cover as defined in claim 1 wherein the protective cover is formed of any suitable yieldable plastic material.

* * * * *